United States Patent [19]

Ray et al.

[11] Patent Number: 4,582,116

[45] Date of Patent: Apr. 15, 1986

[54] EXTRACTION METHOD FOR FILAMENT FORMATION OF HIGH TEMPERATURE REACTIVE ALLOYS

[75] Inventors: Ranjan Ray, Burlington, Mass.; Lee E. Tanner, Berkeley, Calif.

[73] Assignee: Allied Corporation, Morris Township, Morris County, N.J.

[21] Appl. No.: 527,877

[22] Filed: Aug. 30, 1983

Related U.S. Application Data

[63] Continuation of Ser. No. 479,923, Apr. 4, 1983, abandoned, which is a continuation of Ser. No. 220,561, Dec. 29, 1980, abandoned.

[51] Int. Cl.[4] ..... B22D 11/06

[52] U.S. Cl. ..... 164/463; 164/469; 164/479

[58] Field of Search ..... 164/508, 506, 423, 427, 164/429, 438, 463, 479, 485, 480, 428, 469

[56] References Cited

U.S. PATENT DOCUMENTS

| | | | |
|---|---|---|---|
| 3,342,250 | 9/1967 | Treppschuh et al. | 164/438 X |
| 3,522,836 | 8/1970 | King | 164/423 X |
| 3,829,538 | 8/1974 | Darmara et al. | 164/508 X |
| 3,863,700 | 2/1975 | Bedell et al. | 164/423 X |
| 4,257,830 | 3/1981 | Tsuya et al. | 164/429 X |

FOREIGN PATENT DOCUMENTS

| | | | |
|---|---|---|---|
| 7240964 | 8/1975 | Fed. Rep. of Germany . | |
| 2827731 | 1/1979 | Fed. Rep. of Germany . | |
| 54-50463 | 4/1979 | Japan | 164/423 |
| 55-33858 | 3/1980 | Japan | 164/423 |
| 66044 | 7/1950 | Netherlands | 164/428 |
| 1428691 | 3/1976 | United Kingdom . | |
| 1517283 | 7/1978 | United Kingdom . | |

*Primary Examiner*—Nicholas P. Godici
*Assistant Examiner*—J. Reed Batten, Jr.
*Attorney, Agent, or Firm*—Gerhard H. Fuchs

[57] ABSTRACT

A tiltable cooled crucible for containing the molten alloy has a spout for extracting the molten alloy. The alloy is cast on an advanceable chilled surface. The cooled crucible is protected from the molten alloy by a solidified layer of the alloy which is solidified and prevents reaction between the molten alloy and the cooled crucible.

3 Claims, 4 Drawing Figures

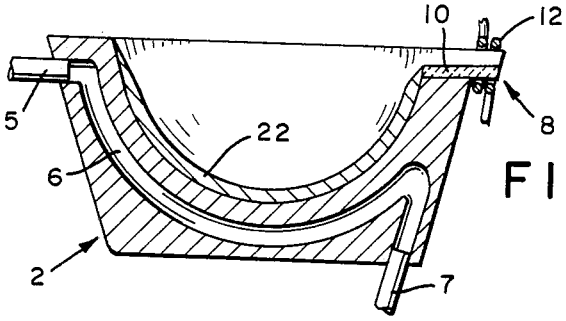
FIG. 2
FIG. 3
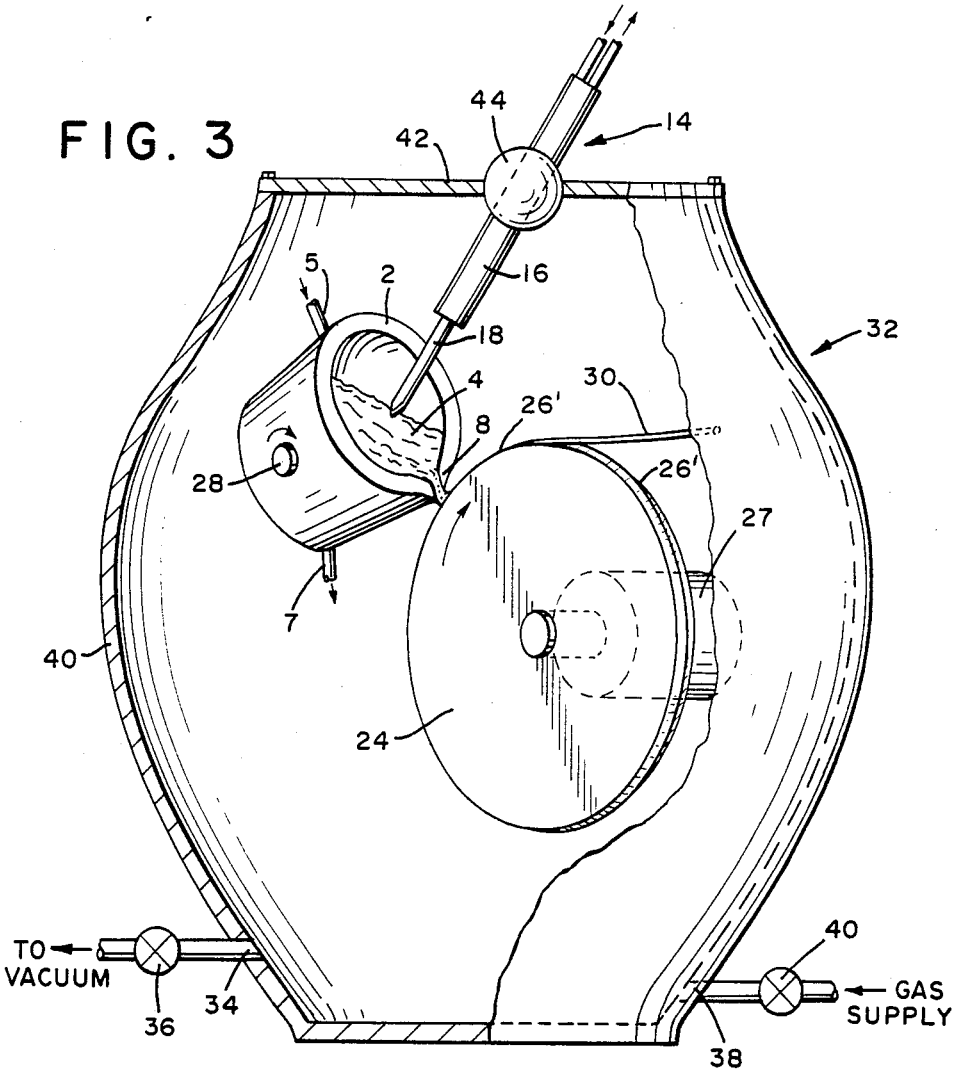

EXTRACTION METHOD FOR FILAMENT FORMATION OF HIGH TEMPERATURE REACTIVE ALLOYS

This application is a continuation of application Ser. No. 479,923 filed Apr. 4, 1983, which in turn, is a continuation of application Ser. No. 220,561 filed Dec. 29, 1980, both now abandoned.

FIELD OF INVENTION

The present invention relates to a method and apparatus for chill casting of high temperature and/or reactive metallic materials. More particularly, it relates to a method and apparatus for the extraction of rapidly-quenched filaments from a high melting point and/or reactive melt.

U.S. Pat. No. 4,471,831 discloses equipment and method for melt-spinning which employs a heat extracting crucible.

BACKGROUND OF THE INVENTION

Extraction of filaments from a liquid melt has been employed to form amorphous metal filaments. For example, Bedell et al., in U.S. Pat. No. 3,863,700, disclose a method and apparatus for filament extraction from molten metal contained in a vessel. The Bedell et al. patent offers no teaching which overcomes the problem of reaction of the melt with the vessel containing the melt when either a high melting or a reactive material is employed. Alloys containing large concentrations of titanium, zirconium, niobium, vanadium, chromium, and the like, when molten are known to react with refractory crucible materials such as alumina, fused silica, zirconia, thoria, yttria, beryllia, and the like. Reaction with the crucible can cause: contamination of the melt which can result in embrittlement of the cast filament; formation of insoluble inclusions in the melt which can reduce the fluidity of the melt, and thereby change its casting characteristics; and attack of the crucible by the melt which will shorten the life of the crucible.

By the appropriate selection of the crucible material employed with a particular alloy, the above-mentioned problems can be minimized but not eliminated. The selection process may require extensive experimentation to determine the compatible combinations of alloy and crucible material. In many cases the crucible material that is subject to minimal attack by the alloy may suffer from thermal instability and be subject to cracking when thermally cycled.

High temperature nickel-base, nickel-chromium-titanium-aluminum alloys have been melted in water-cooled copper crucibles. British Pat. No. 1,517,283, teaches the use of a water-cooled crucible to contain nickel-based alloys. The melt is removed from the crucible by spinning the crucible about its axis to generate atomized particles of liquid which move out radially from the edge of the crucible. This patent offers no teaching that the melt can be extracted from the crucible in the form of a continuous stream of limited dimensions.

Likewise, British Pat. No. 1,428,691 teaches that alloys can be melted in water-cooled molds. The melt is then solidified in situ. This patent offers no teaching of a technique for the extraction of liquid metal from a water-cooled mold.

Since the electrodes used to supply heat to the melts in the above patents are directly above the melt, it is necessary to form a stream of controlled dimensions away from these electrodes if a filament of metal is to be extracted. Thus, while the above patents show a method for melting materials in water-cooled crucibles, they provide no teachings which are suitable for extraction of filaments from the liquid melt.

SUMMARY OF THE INVENTION

The invention provides apparatus for casting metal filament directly from the melt when the metal filament is made from high temperature and/or reactive materials. A heating source such as an electric arc is employed for heating the metal and/or holding it in molten condition. The metal charge is held in a cooled, tiltable crucible, which is constructed of high thermal conductive material. When an arc source is employed, an electrically conductive material is employed for crucible material. Suitable materials of construction for the crucible include copper, graphite, brass, etc.

The crucible has one or more internal passages, and a cooling medium is passed through these channels. When the apparatus includes an electrode, it is associated with the crucible and an arc is struck between the electrode and the metal charge contained in the crucible. The heat generated by the arc is used to melt the metal and/or hold it in molten condition.

To effect rapid quenching of the molten metal and thereby form a continuous filament, the apparatus further includes an advanceable chill surface for depositing the molten metal thereon. The crucible has a pouring spout, and means are provided for tilting the crucible to elevate the molten metal into the spout of the crucible for deposition onto the chill surface as it is being advanced. The chill surface is provided with a heat extracting member which may be constructed of any metal having relatively high thermal conductivity, such as copper, beryllium-copper, molybdenum, iron, and the like. The metal solidifies in contact with the chill surface and is drawn out by the advancing chill surface into a continuous metal strip.

The present invention further provides a method for making continuous metal filament directly from the melt. It involves providing a charge of molten metal in a tiltable crucible having a pouring spout. A solidified layer of the melt is provided to prevent interaction between the melt and the crucible. The crucible is tilted to elevate the molten metal into the spout to form a stream therethrough. The stream is contacted with the chill surface provided by a heat extracting member, and the chill surface is advanced to effect solidification into a continuous strip. The degree of tilt may be adjusted during the casting operation as necessary to provide a continuous flow of molten metal and a filament of uniform cross-section.

BRIEF DESCRIPTION OF THE DRAWING

FIG. 2 is a schematic of the crucible and spout configuration of one embodiment of the present invention wherein the spout contains an insulating insert.

FIG. 3 is a perspective view of another embodiment of the invention where a chamber encloses the crucible and the heat extracting disk.

DETAILED DESCRIPTION OF INVENTION AND THE BEST MODES FOR CARRYING OUT THE INVENTION

Figure 1:
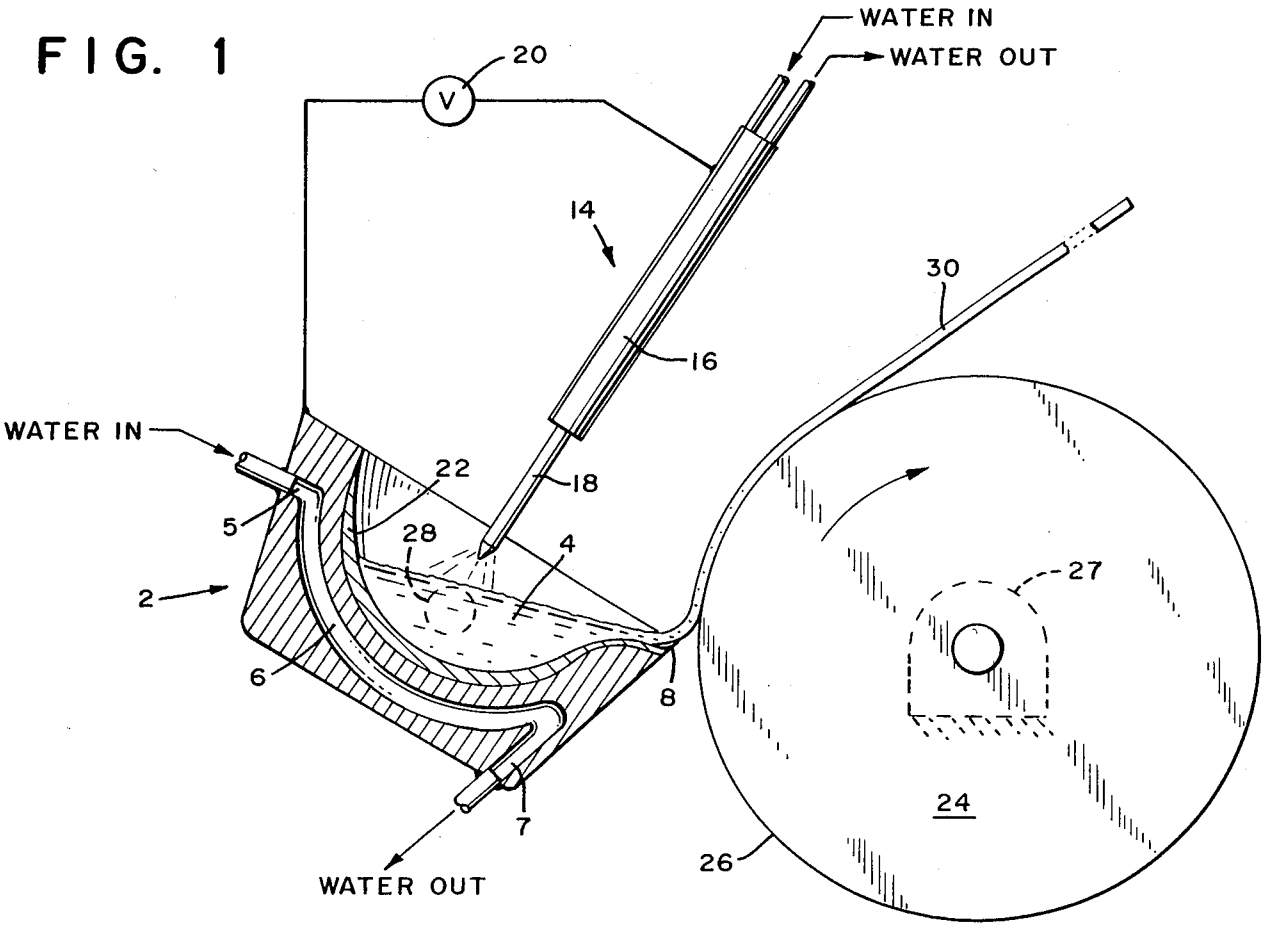
FIG. 1 is a schematic view of a cross-section of one embodiment of the present invention.

FIG. 1 is one embodiment of the present invention. The apparatus has a heat extracting crucible 2 for containment of a molten metal 4. The crucible 2 is fabricated of a high conductivity material such as copper, brass or graphite. The crucible 2 has a coolant inlet 5, a channel 6 and a coolant outlet 7 for the passage of a coolant such as water therethrough. The coolant enhances the heat extracting characteristics of the crucible 2. A spout 8 is positioned on the peripheral edge of the crucible 2.

The spout 8 can optionally be insulated with an insulating insert 10 as is illustrated in FIG. 2. This insert can be made of a material such as zirconia, boron nitride, alumina, or alternatively of a material such as clay graphite. The insert can be heated by heating element 12. When the insert is graphite or clay graphite, it can be readily coupled to a magnetic field, and the heating may be with an induction coil.

Again referring to FIG. 1, a metal charge may be melted to form the molten metal 4 which is maintained liquid in the crucible 2 by means for supplying heat to the charge and/or the molten metal 4. The heating means illustrated is an arc source 14 which preferably has a water-cooled electrode holder 16 and a nonconsumable electrode 18. Typically, tungsten is used as a nonconsumable electrode 18. This electrode 18 is maintained at a potential with respect to the molten metal 4. Typically, the voltage applied between the molten metal 4 and electrode 18 will be between about 200 and 500 volts AC. A power supply 20 is connected between the electrode holder 16 and the crucible 2. The power supply 20 may alternatively be connected to multiple electrodes to provide a potential between the electrodes and the molten metal 4.

It should be appreciated that while the means for heating the molten metal 4 is illustrated as an arc source 14, other means such as an e-beam or a laser could be employed. The molten metal 4 is isolated from the crucible by a solidified layer 22. This solidified layer 22 has the same composition as the molten metal 4. This solidified layer 22, or crust, prevents reaction between the molten metal 4 and the crucible 2.

A heat extracting disk 24 having a circumferential peripheral edge 26 is connected to a means for rotating the disk, such as a motor 27 shown by dashed lines. The disk 24 provides a heat extracting surface with a means for moving the heat extracting surface. Other means such as a rotating belt could also be employed.

When the spout 8 of the crucible 2 is coplanar with the peripheral edge 26 of the disk 24, the spout 8 can be brought into close proximity with the peripheral edge 26 by pivoting the crucible 2 on the pivotal mounts 28. The pivotal motion will bring the molten metal 4 into the spout 8. As the molten metal 4 makes contact with the peripheral edge 26, a filament 30 will be drawn. When the peripheral edge 26 is a right cylindrical surface, the filament drawn will tend to be a flattened ribbon.

For the best control of the filament size, it is preferred that the spout 8 have a channel with a radius of curvature of between about 0.15 cm. and 0.5 cm. The lower limit insures that the channel will remain unconstricted during the casting of the filament 30, while the upper limit is a practical limit beyond which it is difficult to maintain a constant head during the formation of the filament 30.

In the event that a more cylindrical filament is sought, the peripheral edge 26' can be made a tapered convex surface as is illustrated in FIG. 3 by the surface 26'. In this case the spout 8 must be modified so as to have a contoured surface which is a mirror image of the peripheral edge 26'. When the molten metal 4 readily reacts in air, it is preferred to provide a controlled atmosphere. FIG. 3 illustrates a chamber 32 which is provided for enclosing the crucible 2 and the disk 24. The chamber 32 has an outlet 34 for evacuation which is closeable by a valve 36. There is an inlet 38 which again is provided with a valve 40. This inlet 38 serves to supply a protective atmosphere for the crucible 2. The arc source 14 passes through a cover 42 of the chamber 32. A rotatable seal 44 is provided between the electrode holder 16 and the removable cover 42. The removable cover 42 allows access to the crucible 2 and the disk 24.

Figure 4:
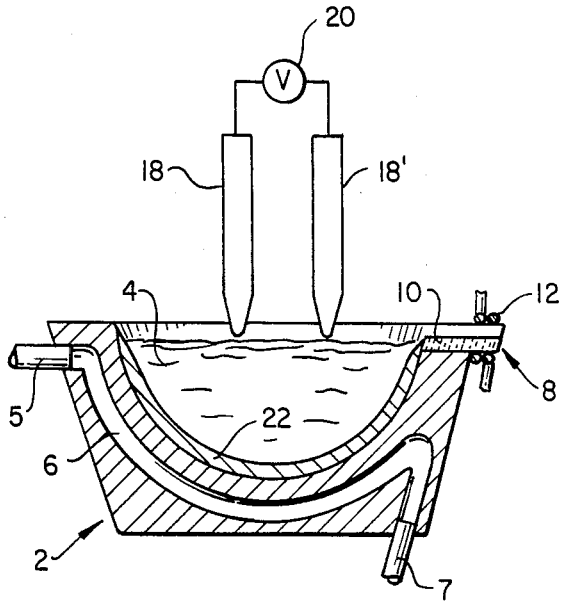
FIG. 4 is a schematic of a two-electrode heating means.

FIG. 4 illustrates an arc heating system with two non-consumable electrodes 18 and 18'. A power supply 20 connects the electrodes with power supply passing current between electrodes 18 and 18' via the metal charge which, when melted, becomes the molten metal 4. In order to further illustrate the present invention the following examples are given.

EXAMPLES 1-9

A series of samples were melted in a water-cooled copper crucible. The charge size varied between 50 and 100 grams. A nonconsumable tungsten electrode was employed to heat the melts. The melts were cast under an argon atmosphere. This was accomplished by placing the crucible and the disk in a chamber which was evacuated to $10^{-4}$ torr and thereafter backfilled with high purity argon to about 20 cm of mercury. An arc was struck between the charge which was in the form of a pellet, and the electrode. By gradually tilting the crucible the molten metal was brought into the spout and in kissing contact with the right cylindrical surface of the rotating chill disk. The disk had a diameter of about 12 inches and was rotated at between about 1200 rpm and 1600 rpm. The disk was a water-cooled molybdenum wheel. A filamentary fiber was extracted or dragged from the melt by the wheel. The materials cast are summarized in Table 1.

TABLE 1

| Metals and Alloys Fabricated as Filaments | Melting Points |
|---|---|
| Ta | 3000° C. |
| Hf | 2200° C. |
| Zr | 1860° C. |
| Ti | 1720° C. |
| $Zr_{80}B_{20}$ (at. %) | 1760° C. |
| Ti—6Al—4V (wt. %) | 1700° C. |
| Ti—13V—11Cr—3Al (wt. %) | 1700° C. |
| Ti—11.5Mo—6Zr—4.5Sn (wt. %) | 1750° C. |
| Ti—7Al (wt. %) | 1700° C. |

It is understood that although the present invention has been specifically disclosed with preferred embodiments and examples, modifications of these concepts herein disclosed may be resorted to by those skilled in the art. Such modifications and variations are considered to be within the scope of the invention and the appended claims.

What is claimed is:

1. A method for making a continuous metal strip directly from a melt which comprises the steps of:

(a) providing a charge of molten metal in a tiltable crucible having a top opening defining a lip for pouring molten metal thereover;

(b) providing a solidified layer of the melt within the crucible in contact with the inner wall of the crucible for preventing interaction between the melt and said crucible;

(c) tilting said crucible to elevate the molten metal to cause it to flow over said lip in a stream;

(d) contacting said stream with a chill surface provided by a heat extracting member;

(e) advancing the chill surface; and (f) quenching the molten metal in one-sided contact with the chill surface at a rapid rate to effect solidification of said melt into a continuous metal strip.

2. The method of claim 1 wherein the step of providing a charge of molten metal in said crucible includes the step of heating the metal charge by passing an electric current therethrough.

3. The method of claim 1 wherein the step of providing a solidified layer of the melt within the crucible comprises the step of maintaining the temperature of said crucible at a temperature below the solidification temperature of the melt.

* * * * *